US008029211B2

(12) United States Patent
Bayerl et al.

(10) Patent No.: US 8,029,211 B2
(45) Date of Patent: Oct. 4, 2011

(54) ADAPTOR FOR SETTING A SELF-DRILLING, CHEMICALLY ANCHORED, FASTENING ELEMENT

(75) Inventors: Michael Bayerl, Tuerkheim (DE); Kay Heemann, Kaufering (DE); Wolfgang Ludwig, Zaisertshofen (DE)

(73) Assignee: Hilti Aktiengesellschaft, Schaan (LI)

( * ) Notice: Subject to any disclaimer, the term of this patent is extended or adjusted under 35 U.S.C. 154(b) by 292 days.

(21) Appl. No.: 12/455,888

(22) Filed: Jun. 8, 2009

(65) Prior Publication Data

US 2009/0304455 A1 Dec. 10, 2009

(30) Foreign Application Priority Data

Jun. 9, 2008 (DE) ..... 10 2008 002 303

(51) Int. Cl.
*E21D 20/00* (2006.01)

(52) U.S. Cl. ..... 405/259.6; 405/259.5; 405/259.1; 175/214

(58) Field of Classification Search ..... 405/295.1, 405/295.5, 295.6; 166/90.1; 175/214; 173/91, 173/132, 213
See application file for complete search history.

(56) References Cited

U.S. PATENT DOCUMENTS

| | | | | |
|---|---|---|---|---|
| 4,449,596 | A * | 5/1984 | Boyadjieff | 175/85 |
| 6,230,824 | B1 * | 5/2001 | Peterman et al. | 175/214 |
| 6,457,910 | B1 | 10/2002 | Ludwig | |
| 2004/0035574 | A1 * | 2/2004 | Pippert | 166/90.1 |
| 2005/0012278 | A1 * | 1/2005 | DeLange | 277/602 |
| 2005/0084339 | A1 * | 4/2005 | Meisenbichler et al. | 405/259.1 |
| 2007/0114070 | A1 * | 5/2007 | Guede | 175/118 |

* cited by examiner

*Primary Examiner* — David Bagnell
*Assistant Examiner* — Kyle Armstrong
(74) *Attorney, Agent, or Firm* — Abelman, Frayne & Schwab

(57) ABSTRACT

An adaptor for setting a self-drilling, chemically anchorable, fastening element (5) includes a rotor member (21) rotatably supported in the adaptor housing (36) and having at its opposite ends (23,25) respectively, a coupling section (24) for connecting the rotor member (21) with a drilling tool (8) for joint rotation therewith, and a coupling receptacle (26) for fixedly receiving a free end (6) of the fastening element (5). Support elements (52,53) are provided in one of two housing parts (41,51) for rotatably supporting the rotor member (21). Sealing elements (42), which are provided in another housing part (41), for a connection channel section (32) that connects a connection opening (37) in the housing (36) for the ejection medium (4) with a feeding channel (31) in the rotor member (21).

10 Claims, 1 Drawing Sheet

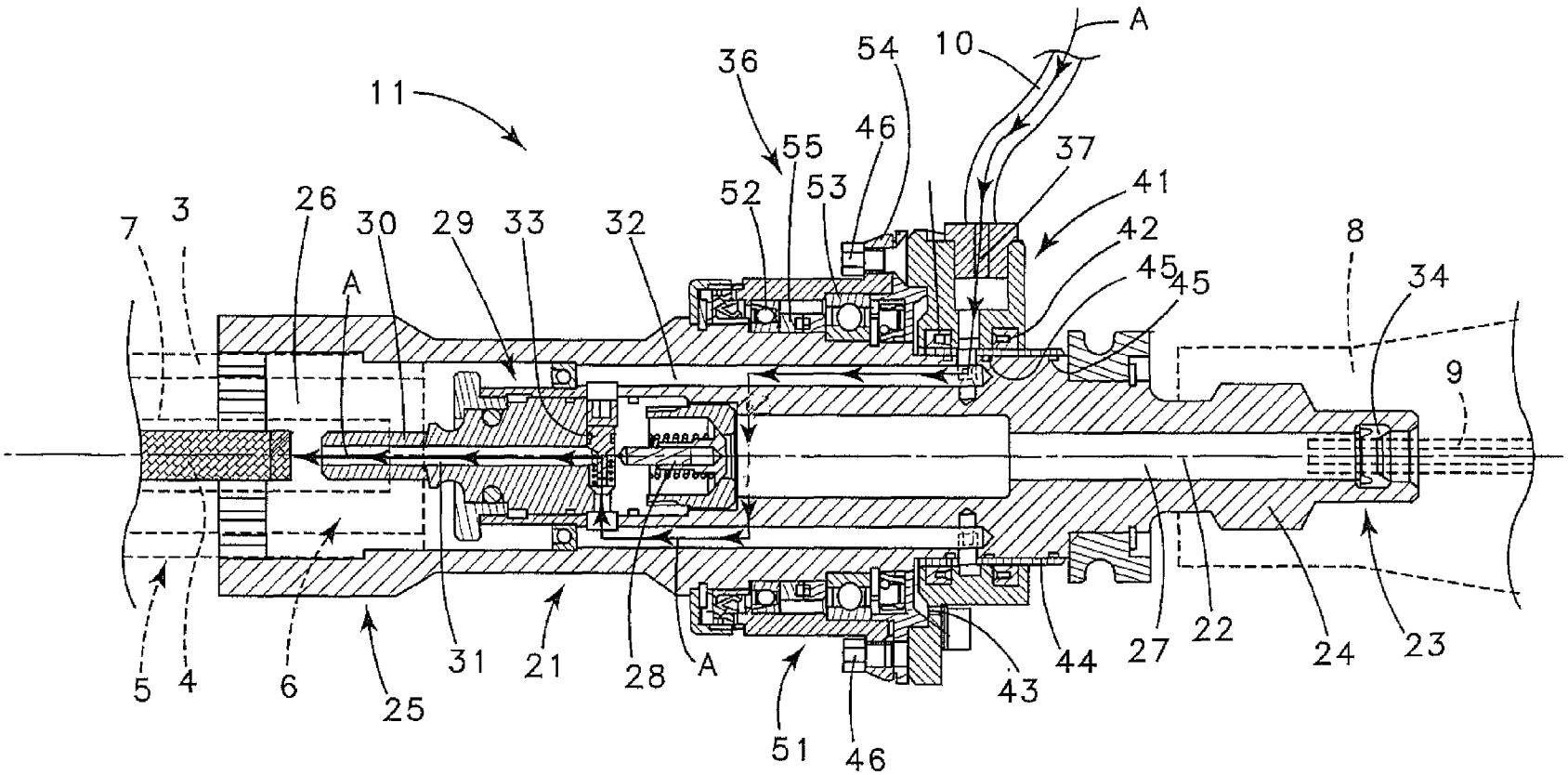
9
34
8
23
24
22
27
45
45
41
42
A
37
10
44
43
54
46
53
55
36
52
46
51
A
32
28
21
33
29
31
11
30
25
A
26
6
3
4
7
5

ADAPTOR FOR SETTING A SELF-DRILLING, CHEMICALLY ANCHORED, FASTENING ELEMENT

BACKGROUND OF THE INVENTION

1. Field of the Invention

The present invention relates to an adaptor for setting a self-drilling, chemically anchorable, fastening element and including a rotor member rotatably supported in the adaptor housing and extending along a longitudinal axis and having a coupling section provided at its first end for connecting the rotor member with a drilling tool for joint rotation therewith, a coupling receptacle provided at a second end of the rotor member opposite the first end for fixedly receiving a free end of the fastening element for joint rotation of the fastening element with the rotor member, and a feeding channel for an ejection medium and opening into the coupling receptacle. A connection channel section for connects a connection opening provided in the housing for the ejection medium with the feeding channel of the rotor member. Support elements are provided between the housing and the rotor member for rotatably supporting the rotor member, and sealing elements are provided also between the housing and rotor member for sealing the connection channel section.

2. Description of the Prior Art

Self-drilling, chemically anchorable, fastening elements used in construction and, in particular, self-drilling, chemically anchorable rock anchors for use in mine and tunnel regions are known for a long time. They are used primarily for stabilization of excavation or of walls in hollow spaces such as tunnels, galleries, and the like. During formation of cavities and hollow spaces, mechanical properties and, in particular, the load-carrying capacity of rock layers diminish. These rock layers are anchored with chemically anchorable fastening elements to further located, undamaged rock layers, securing them to the undamaged layers.

German Publication DE 100 17 763 A1 discloses a self-drilling, chemically anchorable, fastening element having an anchor tube provided with a drilling head at one of its ends and an engagement element for the drilling tool at its other, free end. In the tubular member, there are provided a receptacle for the ejectable mass in which the ejectable mass itself and an ejection piston are located. In the first step, the fastening element, which is driven by the drilling tool, is drilled into a constructional component. In a further step, e.g., after the drilling tool has been disconnected, an ejection device is secured on the engagement element, and the to-be-ejected mass is forced out in the direction of the drilling head by an ejection mechanism. The forced-out mass flows through outlet openings in the drilling head toward the borehole bottom and in an annular gap between the borehole wall and the anchor tube. After the forced-out mass has hardened, the fastening element is anchored in the constructional component.

German Publication DE 103 34 374 A1 discloses an adaptor for setting a self-drilling, chemically anchorable, fastening element in a constructional component, i.e., for drilling the fastening element into the constructional component and for a subsequent forcing-out of the hardenable mass stored in the fastening element. The adaptor has a housing and rotor member rotatably supported in the housing and extending along a longitudinal axis. The rotor member has a coupling section provided at its first end for connecting the rotor member with a drilling tool for joint rotation therewith, and a coupling receptacle provided at a second end of the rotor member opposite the first end for fixedly receiving a free end of the fastening element for joint rotation of the fastening element with the rotor member. In the rotor member, there is provided a feeding channel for an ejection medium and which opens into the coupling receptacle. In the housing, there is provided a connection opening for an ejection medium. A connection channel section connects the connection opening with the feeding channel of the rotor member.

Between the housing and the rotor member, there are provided support elements for rotatably supporting the rotor member and which are spaced from the outer rim of the housing. Between the housing and the rotor member, there are also provided sealing elements for sealing the connection channel section. The sealing elements are spaced from the support elements.

Water under high pressure is used as an ejection medium for forcing out the hardenable mass from the fastening element. In addition, there is provided a second, rinsing water channel extending in the axial direction of the rotor member. During the drilling process, rinsing water is fed to the drilling head of the fastening element through this channel. Also, drillings from the region of the drilling head can be removed through channel.

The adaptor of DE 103 34 374 A1 provides for drilling and subsequent forcing out of a hardenable material, without a need to disconnect the drilling tool and to provide a separate ejection device for ejecting the hardenable mass contained in the fastening element. This substantially reduces the costs associated with setting of a fastening element.

However, the drawback of the known device consists in that upon wear of sealing elements, the resulting leakage leads to the damage of support elements and makes manufacturing and maintenance of the adaptor more expensive.

Accordingly, an object of the present invention is to provide an adaptor of the type described above having a simplified design and service-friendly.

SUMMARY OF THE INVENTION

This and other objects of the present invention, which will become apparent hereinafter, are achieved, according to the present invention, by forming the housing of two parts one of which contains the sealing elements and another one contains support elements.

In this way, the housing is formed of two separate modules, with the first housing part having the function of transmission of the ejection medium of the fastening element, and the second housing part having the function of supporting the rotor member. The separation of two functions permitted to make the separate modules compact and with smaller dimensions. The two housing parts are independent from each other, which provides for their replacement individually.

The sealing elements are advantageously formed as ring-shaped elements suitable for placement in a groove. The first housing part has no support elements in its axial end regions with respect to the rotor member. Thereby, the sealing elements an be arranged in the vicinity of the axial ends of the first housing part, which makes them easily accessible and facilitates their replacement in case of wear. The supporting elements, which can be formed, e.g., as grooved ball bearings can have a small spacing which is sufficient for supporting the rotor member in the second housing part. This permits to form the second housing part very compact, with a short length. Advantageously, in the second housing part, there are provided, in its axial end region with respect to the rotor member, sealing elements which are easily accessible from outside, which makes these optional sealing elements likewise easily replaceable in case of wear.

Advantageously, the two housing parts are directly connectable with each other by appropriate connection means, e.g., screws, so that the second housing part directly adjoins the first housing part in the axial direction. This provides for compactness of the entire housing, and the entire adaptor has a shorter length. This is a substantial advantage during the use of the adaptor in mines where fastening elements are set in regions with at most rather narrow spatial characteristics.

Advantageously, an attachment flange is provided on at least one of the first and second housing parts for connecting the first and second housing parts together. This enables an easy arrangement of connection means from outside. Advantageously, the attachment flange is provided on a second housing part with support elements.

Advantageously, the first housing part, which contains the sealing elements, is provided with at least one drainage bore. The drainage bore permits to discharge possible leaks of the ejection medium between the rotor member and the first housing part and from the entire housing. This prevents damage of the support elements located in the second housing part from the leaked hardenable mass to a most possible extent. Advantageously, several drainage bores are provided which, preferably, are distributed radially circumferentially at a distance from each other. Advantageously, the second housing part also has at least one drainage bore that discharges any ejection medium leak that may eventually reach the second housing part. This further protects the support elements.

Advantageously, the first housing part is located adjacent to the first end of the rotor member and the second housing part is located adjacent to the second end of the rotor member. This arrangement of the housing parts relative to each other provides, at a shorter length of the adaptor, a sufficient length for diverting the ejection medium from the housing into the rotor member.

Advantageously, there are provided two support elements in the second housing part at least one of which is preloaded by a spring. The preloading of at least one support element insures a backlash-free support of the rotor member. This permits to reduce the distance between the two support elements and, thereby, the entire length of the second housing part.

Advantageously, the first housing part has a slide sleeve provided between the sealing elements and the rotor member, which prevents a direct contact between the sealing elements and the rotor member. This insures an easy assembly and a good performance for a long time. The slide sleeve protects the sealing elements from both wear and corrosion, and facilitate the mounting of the first housing part, which takes up the sealing function, on the rotor member.

Advantageously, for sealing the slide sleeve relative to the rotor, there are provided additional sealing elements, e.g., O-rings arrangeable between the slide sleeve and the rotor member.

Advantageously, the slide sleeve is formed of a corrosion-resistant material which is particularly advantageous when water is used as an ejection medium. Advantageously, the slide sleeve is fixedly secured on the rotor for joint rotation therewith and is in direct contact with the sealing elements in the first housing part. Therefore, the slide sleeve, which is formed of a corrosion-resistant material, has little wear and further insures good performance for a long time of the first housing part.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS:

In the Drawings:

Single FIGURE shows a cross-sectional view of an adaptor according to the present invention for setting a self-drilling, chemically anchorable fastening element.

DETAILED DESCRIPTION OF THE PREFERRED EMBODIMENT

An adaptor 11 according to the present invention, which is shown in the drawing, is used for setting a self-drilling, chemically anchorable, fastening element 5 only partially shown in the drawing and formed as a rock anchor, with a drilling tool 8 also only partially shown in the drawing. For setting the self-drilling, chemically anchorable, fastening element 5, firstly, the fastening element 5 is drilled into a construction component and then, the hardenable mass, which is located in the fastening element 5, is pressed out.

The adaptor 11 has a housing 36 and a rotor member 21 located in the housing 36 and extending along a longitudinal axis 22. The rotor member 21 has, at its first end 23, a coupling section 24 for connecting the rotor member 21 to the drilling tool 8, without possibility of rotation of the rotor member 21 relative to the drilling tool 8. At its second end 25 opposite the first end 23, the rotor member 21 has a coupling receptacle for receiving a free end 6 of the fastening element 5 for joint rotation of the rotor member 21 with the fastening element 5. The rotor member 21 is provided with a rinsing water channel 27 that extends along the entire axial extent of the rotor member 21. The rinsing water channel 27 is connectable which the rinsing water feeding nose 9 of the drilling tool 8 and opens into the coupling receptacle 26. A check valve 28 is provided in the rinsing water channel 27. In the region of the rotor member 21 adjacent to the coupling receptacle 26, there is provided a feeding unit 29 having a feeding nose 30 connectable with an inner tube 7 that contains the to-be ejected mass 4 for chemically anchoring the fastening element 5. In the feeding nose 30, there is provided a feeding channel 31 for water that is used as an ejection medium. The feeding channel 31 opens into the coupling receptacle 26.

The housing 36 has a connection opening 37 for the ejection medium which is connected with the feeding channel 31 by a connection channel section 32. A further check valve 33 is provided between the feeding channel 31 and the connection channel section 32.

The housing 36 has a first housing part 41 and a second housing part 51. In the first housing part 41, there are formed annular grooves in which sealing elements 42 are arranged. The sealing elements 42 are located between the first housing part 41 and the rotor member 21 and seal the connection channel section 32. In the second housing part 51, there are arranged two, spaced from each other, support elements 52, 53 with rotatably support the rotor member 21 in the second housing part 51. The support elements 52, 53 are preloaded with a spring 55 located therebetween. The first housing part 41 includes a slide sleeve 44 located between the sealing element 42 and the rotor member 21. The slide sleeve 44 is formed of a corrosion-resistant material, e.g., of stainless steel. For sealing the slide sleeve 44 relative to the rotor member 21, there are provided two further sealing elements 45 formed as O-rings and located in respective recesses formed in the rotor member 21. The slide sleeve 44 can be fixedly connected with the rotor member 21 for joint rotation therewith.

The first housing part 41 is located adjacent to the first end 23 of the rotor member 21, and the second housing part 51 is located adjacent to the second end 25 of the rotor member 21. The first and second housing parts 41 and 51 are directly connected with each other by screws which form connection elements 46. To this end, a radially projecting attachment flange 54 is provided on the second housing part 51. For draining the ejection medium that can eventually seep into the housing 36, there are provided, in the first housing part 44, a plurality of circumferentially distributed and spaced from each other, radial drainage bores 43 of which only a single bore 43 is shown in the drawing.

Below, the setting process of a fastening element 5, in which the inventive adaptor 11 is used, will be described. The adaptor 11 is connected, on one hand, with the drilling tool 8, whereby the rinsing water delivery nose 9 of the drilling tool 8 penetrates in the rinsing water channel 27 of the rotor member 21. In the region of the first end 23 of the rotor member 21, a seal 34 is provided in rinsing water channel 27. In the coupled condition of the adaptor 11 with the drilling tool 8, the seal 34 sealingly surrounds the rinsing water supply nose 9. On the other hand, the adaptor 11 is coupled with the free end 6 of the fastening element 5, with the feeding nose 30 of the feeding unit 29 extending into the open end of the inner tube 7. At the other end of the fastening element 5, a drilling head, not shown, is provided. The connection opening 37 of the housing 36 is connected with a conduit 10 for the ejection medium.

In the first step, the rotor member 21 of the adaptor 11 transmits the rotational movement of drilling tool 8 to the self-drilling fastening element 5. During the drilling process, the rinsing water is fed from the drilling tool 8 through the rinsing water channel 27 of the rotor member 21 and the check valve 28 into the space between the inner tube 7 and the outer tube 3 and to the drilling head. After a predetermined bore depth has been reached, the rotational movement of the drilling tool 8 is interrupted or stopped. Thereafter, the ejection medium, here water under high pressure, is fed into the inner tube 7 of the fastening element 5 through the conduit 10, which is connected to an ejection medium source, the first housing part 41, the connection channel section 32, the further check valve 33, and the feeding channel 31, as shown with arrows A. As a result, the hardenable mass 4, which is located in the inner tube 7, is forced out through openings in the region of the drilling head and into the space surrounding the fastening element 5. The check valve 28 prevents, in case of eventual back-flow of the forced-out mass 4 through the annular gap between the inner tube 7 and the outer tube 3 of the fastening elements 5, penetration of the mass 4 into the interior of the adaptor 11 or even into the drilling tool, whereby their soiling is prevented.

After the hardenable mass 4 hardens in the borehole, the adaptor 11 and the drilling tool 8 are decoupled from the fastening elements that remains in the borehole, and are available for setting of another fastening element.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. An adaptor for setting a self-drilling, chemically anchorable, fastening element (5), comprising:

a housing (36) having separate first housing part (41) and second housing part (51);

a rotor member (21) rotatably supported in the housing (36) and extending along a longitudinal axis (22), the rotor member (21) having a coupling section (24) provided at a first end (23) thereof for connecting the rotor member (21) with a drilling tool (8) for joint rotation therewith, a coupling receptacle (26) provided at a second end (25) of the rotor member (21) opposite the first end (23) for fixedly receiving a free end (6) of the fastening element (5) for joint rotation of the fastening element (5) with the rotor member (21), and a feeding channel (31) for an ejection medium and opening into the coupling receptacle (26);

a connection channel section (32) for connecting a connection opening (37) provided in the housing (36) for the ejection medium with the feeding channel (31) of the rotor member (21);

support elements (52, 53) provided in the second housing part (51) for rotatably supporting the rotor member (21); and sealing means (42) provided in the first housing part (41) for sealing the connection channel section (32).

2. The adaptor according to claim 1, further comprising connection means (46) for directly connecting the first and second housing parts (41, 51) together.

3. The adaptor according to claim 2, wherein an attachment flange (54) is provided on at least one of the first and second housing parts (41, 51) for connecting the first and second housing parts (41, 51).

4. The adaptor according to claim 1, wherein the first housing part (41) is provided with at least one drainage bore (43).

5. The adaptor according to claim 1, wherein the first housing part (41) is located adjacent to the first end (23) of the rotor member (21) and the second housing part (51) is located adjacent to the second end (25) of the rotor member (21).

6. The adaptor according to claim 1, wherein the support elements (52, 53) comprise at least two support elements (52, 53), and wherein the adaptor (11) has a spring (55) for preloading at least one of the two support elements (52, 53).

7. The adaptor according to claim 1, wherein the first housing part (41) has a slide sleeve (44) located between the sealing means (42) and the rotor member (21).

8. The adaptor according to claim 7, wherein the slide sleeve (44) is formed of a corrosion-resistant material.

9. The adaptor according to claim 1, wherein the fastening element (5) has an inner tube (7) containing hardenable material (4) for chemically anchoring the fastening element, and wherein the adaptor includes feeding means (29) defining the feeding channel (31) and having a feeding nose (30) connectable with the inner tube (7) of the fastening element (5), when the fastening element (5) is received in the coupling receptacle (6), for forcing the hardenable mass out upon application of pressure of the ejection medium thereto.

10. The adaptor according to claim 1, further comprising means for releasably connecting the first housing part (41) and the second housing part (51).

* * * * *